US008711193B2

(12) United States Patent
Benton et al.

(10) Patent No.: US 8,711,193 B2
(45) Date of Patent: Apr. 29, 2014

(54) PRINTING APPARATUS AND METHOD OF OPERATION OF A PRINTING APPARATUS

(75) Inventors: Frances H. Benton, Keene, NH (US); Peter Carey Landers, Marlborough, NH (US); Mark Rapposelli, Peterborough, NH (US); Simon Starkey, Ashby de la Zouch (GB)

(73) Assignee: Markem-Imaje Limited, Nottingham (GB)

( * ) Notice: Subject to any disclaimer, the term of this patent is extended or adjusted under 35 U.S.C. 154(b) by 22 days.

(21) Appl. No.: 13/399,665

(22) Filed: Feb. 17, 2012

(65) Prior Publication Data

US 2013/0215209 A1 Aug. 22, 2013

(51) Int. Cl.
*B41J 25/316* (2006.01)

(52) U.S. Cl.
USPC ..... 347/198

(58) Field of Classification Search
USPC ..... 347/185, 186, 187, 188, 198, 194, 195, 347/197, 220; 400/120.14, 120.15, 120.16
See application file for complete search history.

(56) References Cited

U.S. PATENT DOCUMENTS

| | | | | |
|---|---|---|---|---|
| 4,563,691 | A * | 1/1986 | Noguchi et al. | 347/190 |
| 4,675,701 | A | 6/1987 | Chu et al. | |
| RE32,897 | E | 3/1989 | Salmon et al. | |
| 5,442,381 | A | 8/1995 | Fukubeppu et al. | |
| 5,806,996 | A | 9/1998 | Leys et al. | |
| 6,411,317 | B1 | 6/2002 | Fukuda | |
| 6,819,347 | B2 * | 11/2004 | Saquib et al. | 347/194 |
| 6,853,677 | B2 | 2/2005 | Kim et al. | |
| 7,170,756 | B2 | 1/2007 | Balakrishnan | |
| 7,352,381 | B2 * | 4/2008 | Nakanishi | 347/206 |
| 2007/0120941 | A1 | 5/2007 | Nakanishi | |
| 2010/0085411 | A1 | 4/2010 | Chen et al. | |

FOREIGN PATENT DOCUMENTS

| | | | | |
|---|---|---|---|---|
| EP | 0856409 | A2 | 8/1998 | |
| EP | 1775139 | A2 | 9/2001 | |
| EP | 1747859 | A1 | 1/2007 | |
| GB | 2247213 | A | 2/1992 | |
| GB | 2416740 | A | 2/2006 | |
| JP | 01-77560 | * | 3/1989 | 347/194 |
| JP | 04-016364 | * | 1/1992 | 347/194 |
| JP | 8-150750 | * | 6/1996 | B41J 2/335 |
| JP | 2002079697 | A | 3/2002 | |
| JP | 2004255730 | A | 9/2004 | |

OTHER PUBLICATIONS

Search Report under Section 17 in Application No. GB1205666.9 dated Jul. 17, 2012, 1 page.

* cited by examiner

*Primary Examiner* — Huan Tran
(74) *Attorney, Agent, or Firm* — Fish & Richardson P.C.

(57) ABSTRACT

A printing apparatus including a printhead for transferring ink from a ribbon to a substrate to be printed, a print roller for guiding the substrate to be printed, a peel-off roller for separating the ribbon from the substrate, downstream of the printhead, wherein a peel-off angle is subtended between a portion of ribbon which, when the printing apparatus is in use, extends between the printhead and the peel-off roller and a tangent to the print roller at a contact point on the circumference of the print roller, and a printhead angle is subtended between a part of the printhead which transfers ink from the ribbon to the substrate and a radius of the print roller at the contact point, and wherein the printhead angle is adjustable in accordance with the speed of the ribbon relative to the printing apparatus.

28 Claims, 6 Drawing Sheets

PRINTING APPARATUS AND METHOD OF OPERATION OF A PRINTING APPARATUS

BACKGROUND

The invention relates to a printing apparatus and a method of operation of such a printing apparatus, in particular, a transfer printing apparatus.

In such a printing apparatus (a part of which is shown in FIGS. 1 to C), inked ribbon 24 is positioned adjacent a substrate 22 to be printed, and ink is transferred from the ribbon 24 to the substrate 22 during a printing operation. It is well known to provide a pair of spools, one of which is a supply spool, from which unused inked ribbon is unwound, and the other of which is a take-up spool, on to which ribbon, from which ink has been removed, is wound. It is known to control the rotation of one or both of the spools, so as to appropriately control the transfer of the ribbon from the supply spool to the take-up spool, and in a reverse direction, if required. The ribbon thus advances in a ribbon path between the two spools.

A printhead 12 is provided adjacent the ribbon path, and is operable to transfer ink from the ribbon 24 to the substrate 22 to be printed. It is known to operate transfer printers in two different configurations, the first being "intermittent printing", wherein, in use, the substrate 22 is held stationary during each printing operation, and the printhead 12 is moved relative to the substrate 22 to effect printing; and the second being "continuous printing", in which the printhead 12 may be still or moved, while the substrate 22 is moved past the printhead 12, in a path adjacent the ribbon path, during printing operations. It is also known to provide a printing apparatus which is capable of being operable in either configuration.

Particularly in continuous printing configurations, it is known to provide a print roller 20 over which the substrate passes, and which may be driven to advance the substrate 22 past the printhead 12. The print roller 20 is positioned near to the printhead 12, on the opposite side of the ribbon 24 from the printhead 12, such that, during a printing operation, a portion of the substrate 22 and a portion of the ribbon 24 are positioned between the print roller 20 and the printhead 12.

During a printing operation, the printhead 12 moves in a direction which is substantially transverse to the direction of movement of the ribbon 24 and the substrate 22 in their respective paths, i.e., towards the ribbon 24 and the substrate 22. In a thermal printing apparatus, the printhead 12 includes a plurality of thermally energisable printing elements, each of which is selectively energisable, so as to enable a pixel of ink to be transferred to the substrate 22. The energisation of the printing elements is controlled so as to transfer ink to the substrate 22 in a desired pattern, for example to print data and/or an image on to the substrate 22. In order to complete the transfer process, the printhead 12 contacts an ink-free side of the ribbon 24, and presses the opposite, inked, side of the ribbon 24 against the substrate 22 so as to transfer pixels of ink, which have been heated, from the ribbon 24 to the substrate 22. The ribbon 24 is then separated from the substrate 22 by means of passing the ribbon 24 over a peel-off device, for example a roller 26.

The length of time that a pixel of ink is exposed to a heated printing element prior to the pixel being transferred from the ribbon 24 to the substrate 22 affects print quality, and there is an optimum heating period, to achieve a satisfactory transfer. If the ink is not heated for long enough before the printhead 12 contacts the ribbon to transfer the ink, the ink tends to adhere to the ribbon 24, rather than being transferred cleanly on to the substrate 22. Therefore, the resulting print can be patchy and inconsistent. If the ink is heated for too long before the printhead 12 contacts the ribbon 24, the ink can become too fluid, resulting in a blurred or smeared print.

Therefore, in order to obtain a satisfactory print quality, it is known in the art to adjust the position of the printhead 12 relative to the roller 20, for example horizontally or vertically, using shims. In printers where the printhead 12 is stationary relative to the print roller 20, it is known to mount the printer on a plate which can be adjusted substantially horizontally along a tangent to the print roller 20 struck at the top dead centre position E. FIGS. 1 to C show the printhead 12 in three different positions relative to the print roller 20. Of course, such manual adjustment relies on trial and error and thus is awkward and time consuming, and also wastes ink and substrate, as it is necessary to perform several test printing operations, to ensure that optimum print quality, or as close to optimum print quality as possible, is achieved. Once adjusted, the position of the printhead 12 relative to the print roller 20 is substantially constant, unless and until the position is manually readjusted to improve print quality.

Such adjustment of the position of the printhead 12 relative to the print roller 20 is a linear adjustment, in a direction which is substantially parallel with the ribbon path. Therefore, during a print operation, when the printhead 12 is moved "vertically" towards the print roller 20, i.e., in a direction which is transverse to the direction of movement of the ribbon 24 and the substrate 22, the printhead 12 may not be positioned at the top dead centre position E of the print roller 20.

The position of the printhead 12 relative to the print roller 20 is optimised for a particular average printing speed, i.e., an average ribbon speed. The position of the printhead 12 relative to the print roller 20 is generally constant, once set, and does not provide an optimum print quality at all ribbon speeds.

A top dead centre position E is a contact point on the circumference of the print roller 20, defined such that a distance moved by the printhead 12 between a first position and the contact point in the direction transverse to the direction of travel of the ribbon relative to the print roller, is a minimum. A tangent T to the circumference of the print roller 20 at the top dead centre position E subtends an optimal peel off angle $\phi$ relative to the ribbon 24 extending between the contact point and the peel-off roller 26. Aligning the printhead 12 with the top dead centre position E of the print roller 20 may be done by sight and manual adjustment by an operator. Of course, positioning of the printhead 12 is then operator dependent, and is likely to be at least slightly inaccurate.

Another known method of positioning the printhead 12 relative to the top dead centre position E of the print roller 20 is to provide a bracket, which can be mounted in or on a housing of the printing apparatus. However, errors may be incorporated into the position of the printhead 12 relative to the top dead centre position E during positioning of the bracket relative to the housing and the print roller 20.

A further known method of improving print quality at very high printing speeds (i.e., ribbon speeds of above approximately 500 mm/s) is to reduce the thickness of a protective coating on the heating elements of the printhead 12. This enables a steeper thermal gradient to be provided, i.e., warming and melting the ink more quickly than if a thicker coating were provided. A disadvantage of this method is that the useful life of the printhead 12 is decreased, owing to increased wear on the printhead 12 during printing operations. The less protected printhead is vulnerable to abrasion during repeated contact with the ribbon and indirect contact with the substrate and the print roller 20.

SUMMARY

In accordance with the present invention, there is provided a printing apparatus including a print roller for guiding a substrate to be printed, a printhead for transferring ink from a ribbon to the substrate by bringing the ribbon into contact with the substrate at a contact point on the print roller, wherein a printhead angle is subtended between a part of the printhead which transfers ink from the ribbon to the substrate and a radius of the print roller at the contact point, and wherein the printhead angle is adjustable in accordance with the speed of the ribbon relative to the printing apparatus.

An advantage of this invention is that the length of a part of the printhead (the length of the printing element) to which each pixel of ink is exposed before the printhead brings the ribbon into contact with the substrate is adjustable by changing the angle of the printhead. At relatively slow printing speeds, the ribbon passes the printhead and the printing elements relatively slowly. Therefore, the length of time taken for a pixel of ink to pass the heating elements is longer than the length of time taken for a pixel of ink to pass the heating elements at higher printing speeds. By virtue of the invention, at relatively low printing speeds, the length of the heater to which each pixel of ink on the ribbon is exposed before contacting the substrate can be minimised, so that the printing operation is performed before each pixel of ink has been heated for too long. At relatively high printing speeds, the length of the heater to which each pixel of ink on the ribbon is exposed before contacting the substrate can be maximised, so that each pixel of ink is heated for a sufficient length of time before the printhead is brought into contact with the ribbon to transfer the pixel of ink to the substrate.

In accordance with a second aspect of the invention, there is provided a printing apparatus including a print roller for guiding a substrate to be printed, a printhead for transferring ink from a ribbon to the substrate by bringing the ribbon into contact with the substrate at a contact point on the print roller, a printhead angle being subtended between a part of the printhead which transfers ink from the ribbon to the substrate and a radius of the print roller at the contact point, wherein the printhead angle is adjustable, whilst the part of the printhead which transfers ink from the ribbon to the substrate is maintained adjacent a top dead centre position, the top dead centre position of the print roller being a position on the circumference of the print roller defined as the position at which the contact point is the shortest distance of travel of the printhead relative to the print roller, from a retracted, non-printing position to an extended printing position, in a direction which is substantially transverse to a direction of travel of the substrate.

The part of the printhead which brings the ribbon into contact with the substrate does not move "upstream" or "downstream" of the top dead centre position in the general direction of travel of the ribbon relative to the print roller. Therefore, the angle of the tangent subtended at the contact point is maintained substantially constant. Print quality is also dependent on a "peel-off angle" which is subtended between a tangent to the print roller at a contact point on the circumference of the print roller, where the printhead brings the ribbon into contact with the substrate and bears against the print roller, and a portion of ribbon which extends between that contact point and the peel-off device. An optimum peel-off angle is dependent upon the type of ribbon used.

Moving the printhead linearly in a direction which is substantially parallel to the tangent to the print roller at the top dead centre position, as in the prior art, enables the angle subtended by the printhead relative to a radius of the print roller to be adjusted. However, the printhead brings the ribbon into contact with the substrate at a position on the circumference of the roller, the tangent to which is not substantially parallel with the direction of travel of the substrate and/or ribbon. In doing so, the peel-off angle may be affected, preventing clean separation of the ribbon from the substrate and/or causing wrinkling and tracking problems of the ribbon and the substrate as well as changing the position of the printed location on the ribbon. "Spikes" in the magnitude of the tension in the ribbon, owing to the printhead travelling further in a direction which is substantially transverse to the direction of travel of the substrate and the ribbon, to contact the print roller may be caused.

In the present invention, the contact point is co-incident with a position at which the substrate "crests" on the print roller. The location of pixels of ink removed from the ribbon in successive print cycles is important to customers in order to not waste ribbon by leaving gaps between prints and to avoid poor print quality by attempting to remove pixels of ink from a portion of the ribbon from which the required pixels have already been removed in a previous printing operation.

To summarise, print quality can be optimised in two ways, namely by controlling the length of time that each pixel of ink is heated, and by not interfering with the expected peel-off angle, by ensuring that the printhead contacts the ribbon at the top dead centre position of the print roller.

The printhead angle may be automatically adjustable to an optimum angle in accordance with the speed of the ribbon relative to the printing apparatus.

The advantage of this feature is that the time that each pixel of ink is adjacent the heater of the printhead, or "dwell time", can be maintained substantially constant, irrespective of the speed at which the ribbon is moving relative to the printhead. In a thermal transfer printer, the time that each pixel of ink is adjacent a heater element is important, since the quality of each print depends upon the ink being heated to a temperature as close to an optimum temperature as possible. The length of time during which a heater is exposed to the ribbon before contact with the substrate determines the amount of heat absorbed by the ink on the ribbon.

The printhead may be mounted on a printhead support, the printhead being pivotable relative to the printhead support to adjust the printhead angle.

The printhead may include at least one thermally energisable printing element.

Energisation of the (or each) thermally energisable element may be monitored, so as to enable the or each element to be energised by an appropriate amount to reach a predetermined temperature, taking into account a current temperature of the or each element and/or the number of times the or each element has been energised during a predetermined period.

The printing apparatus may include a heating element which preheats a portion of the ribbon, prior to the portion of the ribbon reaching the contact point. The heating element can bring the ink up to its melting point (i.e., heated to just below the glass transition point) so that the printhead heating element need only melt the ink (supplying heat of fusion) and not first bring the ink up to the melting point.

The heating element may be an extension of the thermally energisable printhead.

The heating element may be separate from the printhead, and be positioned upstream of the printhead.

The printing apparatus may include one or more cooling devices for adjusting a temperature of the ink on the ribbon.

The printing apparatus may include a mechanism for locating the top dead centre position of the print roller.

The printhead may be moveable in a first, lateral direction relative to the print roller and may be moveable in a second direction which is substantially transverse to the first direction, between a first position relative to the print roller and a second position, in which the printhead contacts the print roller. It is possible to determine the distance moved during each movement in the second direction, and/or the time taken to complete each movement in the second direction. The shortest time taken and/or distance travelled from a retracted position to contact the roller may be used to determine top dead centre.

The mechanism for locating the top dead centre position of the print roller may include a radiation emitter which is moveable in a lateral direction relative to the print roller, and a radiation detector which detects radiation emitted by the emitter and/or reflected by the print roller, a maximum intensity of radiation being detected by the detector being indicative of the detector being positioned adjacent the top dead centre position.

The detector may detect only collimated radiation and the mechanism for locating the top dead centre position may include at least one lens for collimating radiation reflected from the print roller.

The mechanism for locating the top dead centre position may include at least one radiation emitter, and a pair of radiation detectors, the detectors being positioned equidistantly from the top dead centre position, such that the detectors detecting the same intensity of radiation is indicative of radiation path lengths between the top dead centre position and the detectors being equal, hence enabling the top dead centre position to be identified.

In accordance with a third aspect of the invention, there is provided a printing apparatus including a printer roller for guiding a substrate to be printed, a printhead for transferring ink from a ribbon to the substrate by bringing the ribbon into contact with the substrate at a contact point on the print roller and a top dead centre locating mechanism to locate a top dead centre position of the print roller, wherein the top dead centre position of the print roller is a position on the circumference of the print roller defined as the position at which the contact point is the shortest distance of travel of the printhead relative to the print roller, from a retracted, non-printing position to an extended printing position in a direction which is substantially transverse to a direction of travel of the substrate.

The printhead may be moveable in a first, lateral direction relative to the print roller and in a second direction which is substantially transverse to the first direction, between a first position relative to the print roller and a second position, in which the printhead contacts the print roller.

The top dead centre locating mechanism may include a radiation emitter which is moveable in a lateral direction relative to the print roller, and a radiation detector which detects radiation emitted by the emitter and/or reflected by the printer roller, the maximum intensity of radiation being detected by the detector being indicative of the detector being positioned adjacent the top dead centre position.

The detector may detect only collimated radiation and the top dead centre locating mechanism may include at least one lens to collimate radiation reflected from the print roller.

The top dead centre locating mechanism may include at least one radiation emitter and a pair of radiation detectors, the detectors being positioned equidistantly from the top dead centre position, such that the detectors detecting the same intensity of radiation is indicative of radiation path lengths between the top dead centre position and the detectors being equal, hence enabling the top dead centre position to be identified.

In accordance with a fourth aspect of the invention, there is a provided a method of locating a top dead centre position of a print roller of a printing apparatus, the printing apparatus further including a printhead including at least one printing element, the printhead being operable to transfer ink from an inked ribbon to a substrate to be printed by bringing the ribbon into contact with the substrate at a contact point on the print roller, the method including moving at least a part of the printhead in a lateral direction relative to the print roller, such that the print head traverses the print roller in a first direction, and moving the print head in a direction which is substantially transverse to the first direction, between a first position and a second position in which a part of the printhead contacts the print roller, the method further including determining the lateral position of the printhead relative to the print roller at which the distance between the first position and the second position is a minimum.

The printhead traversing the print roller and the movement of the printhead in the direction which is substantially transverse to the first direction may be performed simultaneously.

The method may include determining the time taken for the printhead to travel from the first position to the second position.

The method may include providing a radiation emitter and a radiation detector which detects radiation emitted by the emitter and/or reflected by the print roller, moving the emitter relative to the print roller in a lateral direction, and monitoring the radiation detected by the detector, to ascertain the position of the emitter relative to the print roller when the intensity of the radiation is maximum, and thus determining the position of the top dead centre position.

The method may include moving the printhead in a first direction laterally relative to the print roller and repeatedly moving the printhead in a second direction which is substantially transverse to the first direction, between a first position relative to the print roller and the second position in which printhead contacts the print roller, and monitoring one of the time taken for the printhead to move between the first position and the second position, and the distance between the first position and the second position, so as to ascertain the shortest distance traveled by the printhead between the first position and the second position, and thus to ascertain the lateral position of the top dead centre position.

In accordance with a fifth aspect of the invention, there is provided a method of adjusting the effective length of a printing element of a printing apparatus, the printing apparatus being of the kind including a print roller for guiding a substrate to be printed, a printhead including at least one printing element, the printhead being operable to transfer ink from an inked ribbon to the substrate by bringing the ribbon into contact with the substrate at a contact point on the print roller, wherein a printhead angle is subtended between a part of the printhead which transfers ink from the ribbon to the substrate and a radius of the print roller at the contact point wherein the method includes adjusting the printhead angle in accordance with the speed of the ribbon relative to the printing apparatus.

In accordance with a sixth aspect of the invention, there is provided a method of adjusting the effective length of a printing element of a printing apparatus, the printing apparatus being of the kind including a print roller for guiding a substrate to be printed, a printhead including at least one printing element, the print head being operable to transfer ink from an inked ribbon to the substrate by bringing the ribbon into contact with the substrate at a contact point on the print roller, wherein the printhead is maintained adjacent a top dead centre position of the print roller, during printing, the top dead centre position being the contact point on the circumference of the print roller at which a distance moved by the printhead between a first position and the contact point in a direction substantially transverse to a direction of travel of the ribbon relative to the print roller, in a minimum.

The method may include locating the top dead centre position of the print roller.

BRIEF DESCRIPTION OF THE DRAWINGS

Embodiments of the invention will now be described, by way of example only, with reference to the accompanying drawings, in which.

DETAILED DESCRIPTION

Figure 1C:
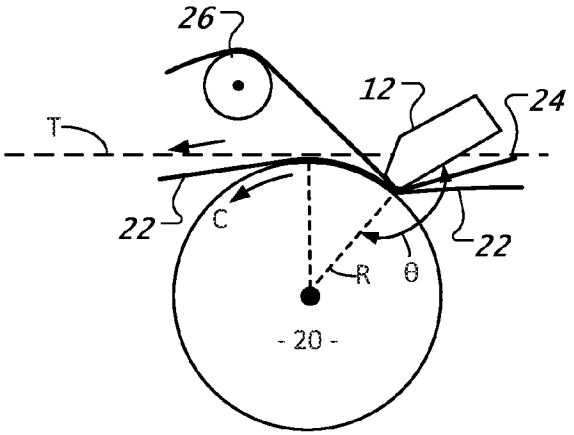
Fig. 1C PRIOR ART
FIGS. 1A-1C show a part of a prior art printing apparatus, wherein a printhead is moveable linearly relative to a print roller.
Figure 1B:
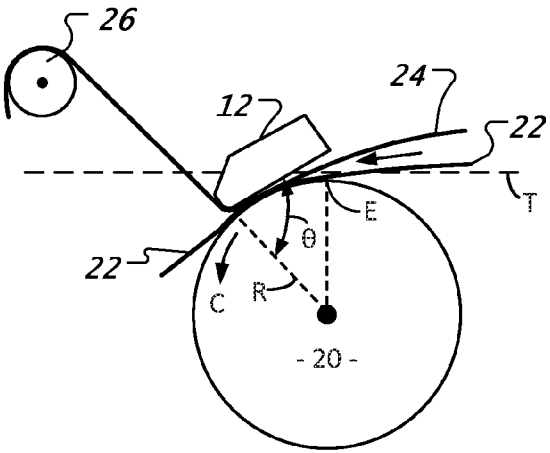
Fig. 1B PRIOR ART
Figure 1A:
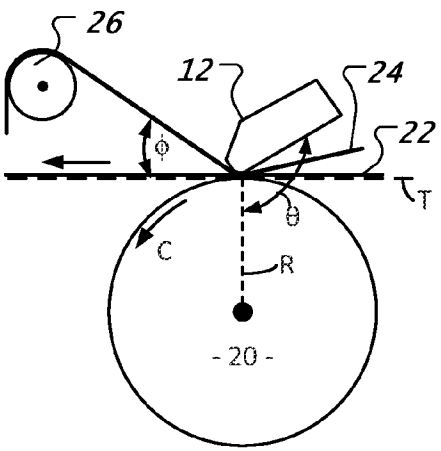
Fig. 1A PRIOR ART
Figure 2:
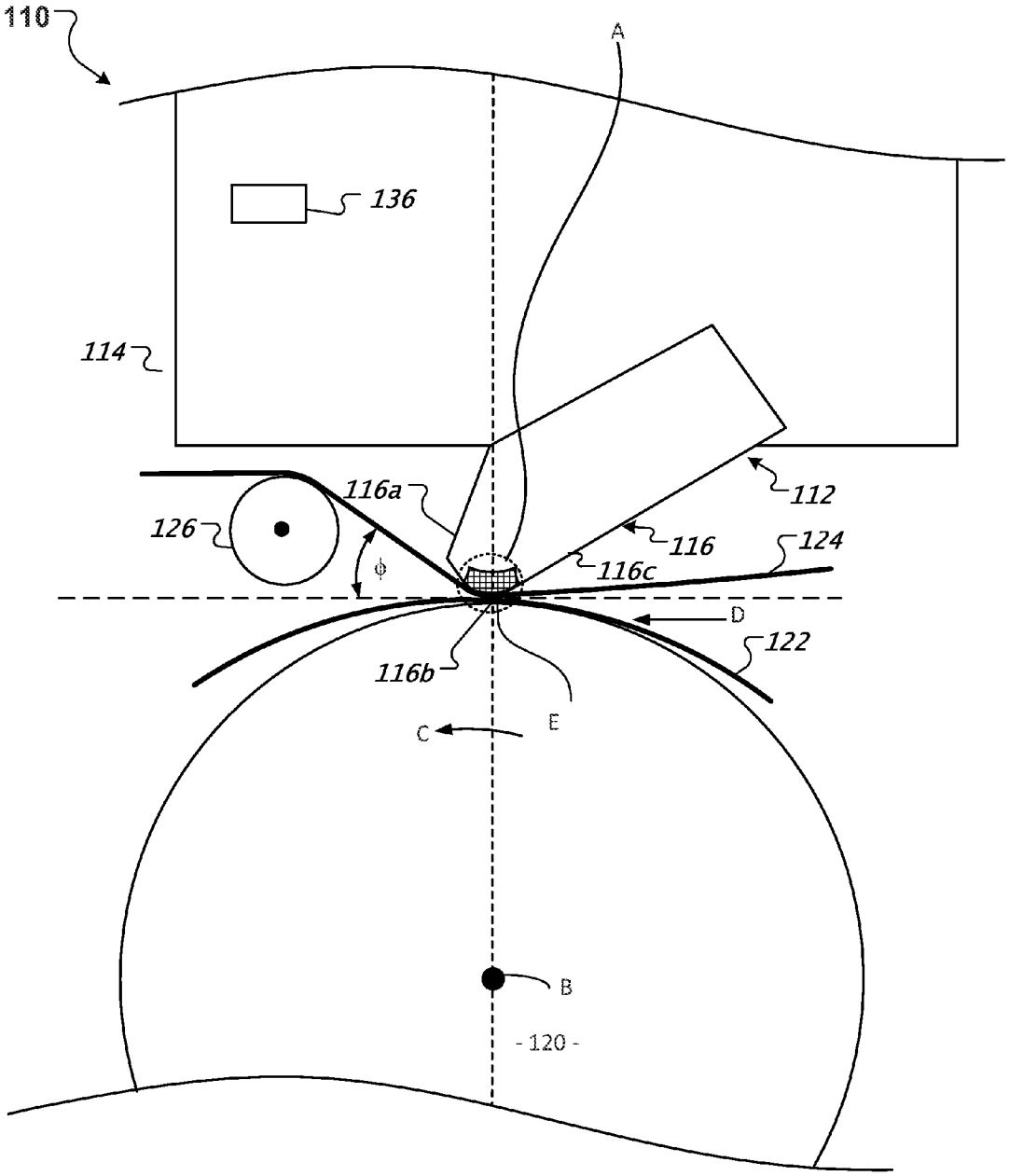
FIG. 2 shows an illustrative view of a part of a printing apparatus in accordance with an aspect of the present invention.
Figure 3:
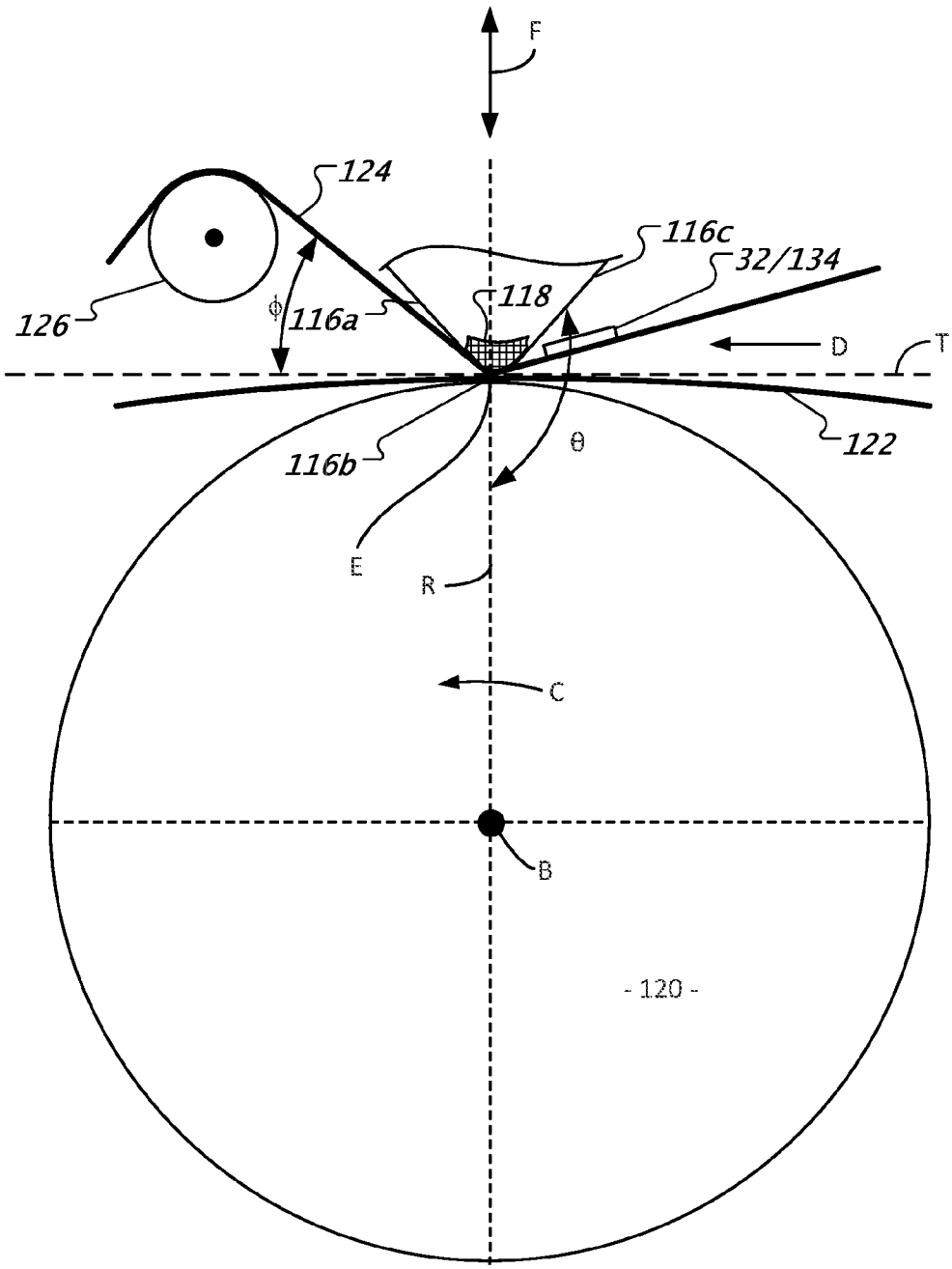
FIG. 3 shows a print angle between a part of a printhead of the printing apparatus of FIG. 2 and a radius of a print roller.
Figure 4C:
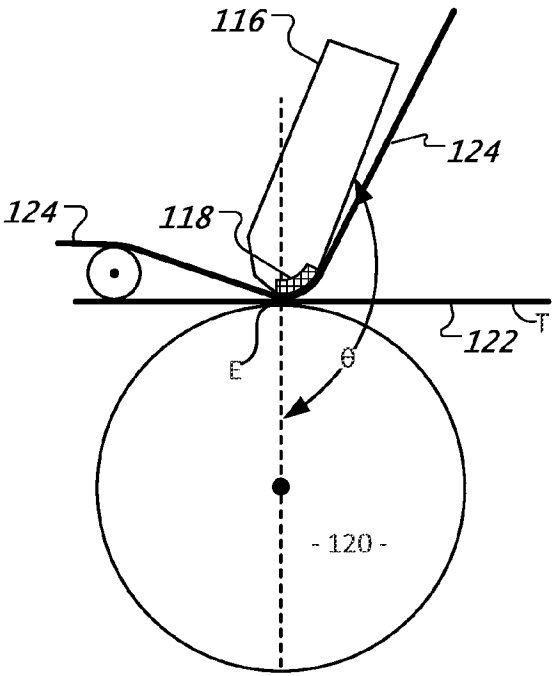
FIGS. 4A to 4C show the printhead at different angles relative to the print roller.
Figure 4B:
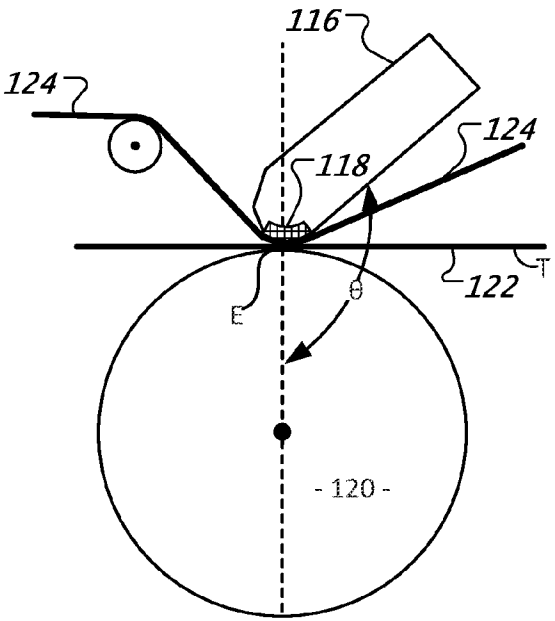
Figure 4A:
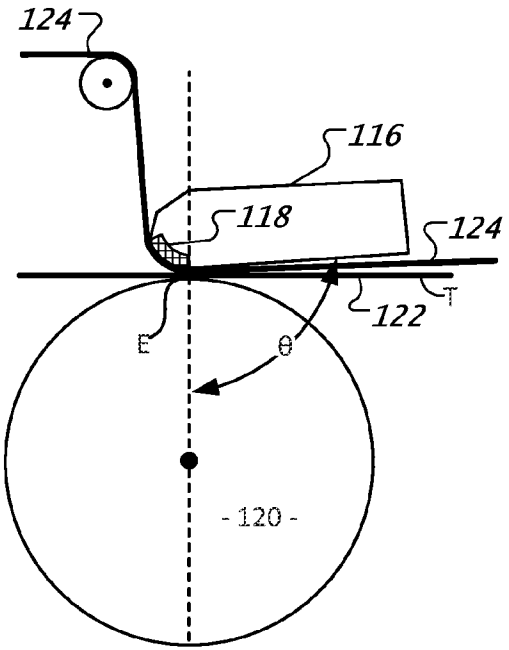

Referring to FIGS. 2 and 3, there is shown a part of a printing apparatus 110, which includes a printhead assembly 112 which includes a printhead support 114 and a printhead 116. The position in which the printhead 116 is mounted on the printhead support 114 is adjustable as will be described in more detail below.

The printhead 116 includes a plurality of selectively thermally energisable printing elements 118, only one of which is visible in FIGS. 2 and 3. The thermally energisable printing elements 118 are arranged along the printhead 116 in a single line, but it will be appreciated that a two dimensional array of printing elements 118 may be provided. Each of the printing elements 118 in this example is an electrically resistive component, the resistance of each element being relatively high, such that supplying electrical energy to an element causes it to heat up. When the supply of electrical energy to a printing element ceases, the printing element cools.

The printhead 116 includes a leading edge 116*c*, a contact edge 116*b*, adjacent which each printing element 118 is positioned, and a trailing edge 116*a*. Each printing element 118 has a length which extends into the printhead 116, away from the contact edge 116*b*.

The printing apparatus 110 includes a printhead adjustment device for adjusting the position of the printhead 116 relative to the printhead support 114, and/or for adjusting the position of the printhead assembly 112 relative to a housing of the printing apparatus 110. The printhead adjustment device includes a motor and a traditional lead screw for adjusting the position of the printhead assembly 112 relative to the housing of the printing apparatus 110. The printhead assembly is rotatable relative to the housing about an axis A which extends in the substantially the same direction as the line of printing elements 118.

The printing apparatus 110 also includes a print roller 120 which is rotatable about an axis B. A substrate to be printed 122 is advanced by means of a motor (not shown) and is guided by the print roller 120. The print roller 120 acts as a backing roller against which the printhead 116 may bear. Advancing the substrate to be printed 122 in the general direction shown by arrow D in FIG. 2 causes the print roller 120 to rotate in an anticlockwise direction, as shown by arrow C, guiding the substrate 122 past the printhead 116 in a substrate path.

The printhead 116 is positioned adjacent a top dead centre position E of the print roller 120. The top dead centre position E is radially aligned with the axis B of the print roller 120 and, in use, is vertically above the axis B. A printhead angle θ is subtended between the direction in which each printing element 118 extends into the printhead 116 from the contact edge 116*b*, and a radius R between the axis B and the top dead centre position E, as shown in FIG. 3. The printhead angle θ is adjustable by virtue of the printhead adjustment device. The printhead angle θ may be adjustable in response to a manual adjustment made by an operator, or automatically, as described in more detail below.

The printing apparatus 110 also includes a ribbon drive, for advancing an inked ribbon 124 past the printhead 116, to enable the printhead 116 to transfer ink from the inked ribbon 124 to the substrate 122. The inked ribbon 124 is also advanced substantially in the direction of arrow D. The ribbon drive is operable to control the movement of the ribbon 124 and to position an unused portion of ribbon 124, i.e., a portion of ribbon 124 which carries ink, adjacent the printhead 116, to enable the printing apparatus 110 to perform a printing operation, during which at least a proportion of the ink carried by the portion of ribbon 124 is transferred to the substrate 122.

The ribbon drive may be a traditional reel-to-reel ribbon drive, or another drive of any appropriate type.

The printing apparatus also includes a peel-off device, which in the present example is a roller 126 which is positioned "downstream" of the printhead 116 when the ribbon is travelling in the direction of arrow D. The peel-off roller 126 is spaced from the print roller 120 and, in use, the ribbon 124 is entrained at least partially around the circumference of the peel-off roller 126, so as to separate the ribbon 124 from the substrate 122 downstream of the printhead 116. As shown in FIG. 3, a peel-off angle ø is subtended between the ribbon 124 extending between the printhead 116 and the peel-off roller 126 and the tangent T.

The printing apparatus 110 includes a device for determining the location of the top dead centre position E (hereinafter referred to as a TDC-locating device). Such a device is optional. The TDC-locating device includes a pair of radiation emitters/detectors 130, preferably infra-red emitters, carried on the printhead support 114, one upstream of the printhead 116 and one downstream of the printhead 116. The emitters/detectors 130 are equidistant from the printhead 116. The print roller 120 is at least partially reflective, so as to be able to reflect radiation towards the detectors 130.

In use, the printing apparatus 110 is configured as a continuous printing apparatus. As such, the substrate to be printed 122 is advanced substantially continuously past the printhead 116 during each printing operation. The ribbon drive advances the ribbon 124 past the printhead 116 during each printing operation. The position of the printhead assembly 112 relative to the print roller 120 in a direction parallel to the arrow D remains substantially constant during each printing operation.

The printhead 116 is positioned adjacent the top dead centre position E, and is moveable in a direction substantially transverse to a tangent T to the print roller 120 at the top dead centre position E, as shown by the double-headed arrow F.

This substantially linear movement of the printhead 116 relative to the printhead support 114 is controlled by a pneumatic cylinder, and brings the printhead 116 into contact with a first (uninked) side of the ribbon 124, and moves the ribbon 124 towards, and into contact with the substrate 122, such that ink is transferable from a second, opposite side of the ribbon 124 on to the substrate 122.

The angle $\phi$ is preferably 45.4° but can range from 35 to 47°.

In more detail, each print operation includes the transfer of one or more pixels of ink from the ribbon 124 on to the substrate 122. The transfer of each pixel of ink requires that pixel to be warmed, such that it changes state from solid to liquid. Each pixel of ink is heated by a printing element 118. Selectively energising the printing elements 118 enables pixels of ink to be warmed and melted in a predetermined pattern, so as to enable readable data and/or an image to be printed on to the substrate.

The length of time for which each pixel of ink is heated affects the print quality, as mentioned above. Warming the ink for too long causes the ink to become too liquid, whereas not heating the ink for long enough means that the ink is unlikely to separate from the ribbon 124 when the printhead 116 presses the ribbon 124 into contact with the substrate 122.

The length of time that each pixel of ink is in thermal transfer proximity with the relevant printing element 118 prior to the printhead 116 bringing the ribbon 124 into contact with the substrate 122 (the dwell time) is dependent upon the effective length of the printing element, i.e., the distance through which the ribbon 124 moves whilst in thermal transfer proximity with the printing element 118 prior to the printhead 116 bringing the ribbon 124 into contact with the substrate 122, and the speed at which the ribbon 124 moves past the printing element 118 of the printhead 116.

After the printhead 116 has contacted the ribbon 124 and the ink has contacted the substrate 122, the ink cools, and adheres to the substrate 122. The position of the peel-off roller 126 affects print quality, since it is important to draw the ribbon away from the ink relatively quickly, so as to avoid pixels of ink which should be transferred to the substrate 122 adhering to the ribbon 124 rather than the substrate 122. The optimum position of the peel-off roller 126, and hence the peel-off angle $\phi$ subtended by the used ribbon 124 relative to the tangent T of the print roller 120 at the top dead centre position E, which provides clean separation of the ink from the ribbon 124, leaving the ink in contact with the substrate 122, ranges from approximately 35° to 47° and is preferably 45.4°.

In order to ensure that each pixel of ink is heated for the optimum length of time, even at high printing speeds, for example, ribbon speeds in excess of 500 mm/s, it is desirable to increase the effective length of the printing element 118. The effective length of the printing element 118 is increased by rotating the printhead 116 relative to the printhead support 114 to adjust the printhead angle $\theta$. In the present embodiment, the printing element 118 and the contact edge 116*b* of the printhead 116 remain positioned adjacent the top dead centre position E of the print roller 120. Such rotation is effectively about an axis which is aligned with the top dead centre position E, so as to maintain the printhead 116 adjacent the top dead centre position E. Maintaining the printhead 116 and the printing element 118 adjacent the top dead centre position E ensures that the optimum peel-off angle $\phi$ is also maintained.

This ensures that each pixel of ink is heated adequately whilst retaining accurate knowledge of the print position and avoiding distorted prints which could be caused by the printhead 116 bringing the ribbon 124 into contact with the substrate at a position other than the top dead centre position E.

The accurate positioning of the ribbon 124 relative to the printhead 116 is important, as it is desirable to position the next portion of ribbon to be used directly adjacent a previously used portion of ribbon, so as to avoid wastage of ink, and to avoid attempting to remove ink from pixel positions from which the ink has already been removed. It is possible to more accurately position a portion of ribbon 124 adjacent the top dead centre position E than an alternative position relative to the print roller 120.

For example in the Kyocera model KCE-53-12PAJ1 printhead, for printing speeds requiring a ribbon speed in excess of 500 mm/s, the printhead angle $\theta$ is advantageously between 115° and 121°, preferably approximately 119.5°.

For slower printing speeds, for example those requiring ribbon speeds of less than 100 mm/s relative to the printhead 116, it is advantageous to ensure that each pixel of ink is not heated for too long before the printhead 116 brings the ribbon 124 into contact with the substrate 122. Therefore it is desirable to reduce the effective length of each printing element 118 when the ribbon 124 passes the printhead 116 at a relatively slow speed, so as to obtain the optimum heating time. In order to reduce the effective length of the printing element 118, the printhead 116 is rotated relative to the tangent T of the print roller 126, such that the printhead angle $\theta$ is less than 115°, preferably between 110° and 115°, and more preferably 113.5°.

The angle $\theta$ is preferably automatically adjustable with reference to the speed of the ribbon 124 relative to the printhead 116. A controller 136 of the printing apparatus 110 determines the speed at which the ribbon is moving, and controls the movement of the printhead 116 relative to the printhead support 114 accordingly by controlling the motor and lead screw of the printhead adjustment device accordingly. This method of angle adjustment reduces the risk of operator error, and thus is more accurate than manual adjustment of the printhead angle $\theta$.

However, it will be appreciated that the printing apparatus 110 may be intended always to operate at a particular ribbon speed. Therefore, rather than the angle $\theta$ being automatically adjustable, the angle $\theta$ may be selected and set in accordance with the intended ribbon speed of the printing apparatus 110.

There are several alternative methods of rotating the printhead 116 relative to the print roller 120, so as to adjust the printhead angle $\theta$ to its optimum size. The first alternative method is to include a position sensor to monitor the position of the printhead 116 and/or the printhead support 114, and to provide a motor which is operable to adjust the position of the printhead assembly 112 relative to the housing of the printing apparatus 110 (or the printhead 116 relative to the printhead support 114), such that the indication of the position of the printhead 116 and/or the printhead support 114 corresponds with the desired printhead angle $\theta$.

Alternatively, the position of the printhead 116 relative to the printhead support 114, and/or the position of the printhead apparatus relative to the housing may be selected and set manually in accordance with an intended ribbon speed of the printing apparatus 110, for example using shims and or fasteners.

Ink absorbs thermal energy from the printing elements 118 to cause the ink to melt. Once the ink is removed from the ribbon 124, air surrounding the printing elements 118 insulates the printing elements 118. It is possible for a controller 136 of the printing apparatus 110 to monitor the past thermal energisation of each printing element 118, and/or to monitor the temperature of each printing element 118. When energising each printing element 118 to a temperature adequate to melt a pixel of ink, the controller 136 takes into account the temperature of the printing element 118 immediately prior to energisation, and/or its energisation history, to provide an estimate of the temperature of the printing element 118. The temperature or energisation history data can then be taken into account by the controller 136 when determining the amount of energy required to heat each individual printing element 118 to the required temperature to melt a pixel of ink. The speed of the substrate may also be taken into account when determining the amount of energy required to heat each printing element. For example, if a printing element 118 which is about to be used for a printing operation has recently been used in a printing operation, it may not have lost all of its heat. This residual temperature can be taken into account when the controller 136 determines the amount of energy required to heat each printing element to its optimum temperature for heating a pixel of ink, such that the amount of energy provided is less than for a cool element. If the substrate 122 is travelling at a high speed, each printing element 118 is likely to need to be heated up to its optimum temperature for heating the ink, quickly, so it may be necessary for the energy provided to each printing element 118 to be relatively high, so as to achieve the optimum temperature in a quick enough time. Preheating elements 32 may optionally be provided to preheat the ink on the ribbon 124 before it reaches the printing elements 118 of the printhead 112.

For printing capabilities requiring very low ribbon speeds, for example 100 mm/s or less relative to the print roller 120, it may not be desirable to rotate the printhead 116 sufficiently relative to the tangent T of the print roller 120 such that the angle θ is small enough to obtain the optimum heating time for each pixel of ink, and to avoid overheating of the ink. Once the ink has been removed from the ribbon the printhead heater elements are likely to overheat because the un-inked ribbon substrate is not a good conductor of heat. Therefore, for very low ribbon speeds, it may also be necessary to maintain the angle for higher speed printing and precooling element 134 may optionally be provided to precool the ink on the ribbon 124 before it reaches the printing elements 118 of the printhead 112. At higher printing speeds, there is very little possibility of overheating ink pixels.

Whilst each of the printing elements 118 is described as being an electrically resistive component, which cools naturally when a supply of electrical energy to the element 118 ceases, the printhead 116 may additionally include (or be associated with) a plurality of cooling devices 134, each of which is capable of cooling the ink on the ribbon 124 near an associated printing element 118 so as to be able to control the temperature experienced by the ink near each printing element 118 more accurately. This enables the heating and cooling of each pixel of ink to be controlled more accurately.

Each printing element 118 may be Peltier device. Applying a voltage across a Peltier device causes one face of the device to warm up, whilst an opposite face of the device cools down. Thus a series or an array of Peltier devices can be used to warm and/or cool pixels of ink as required. Alternatively, the printhead 118 may include a plurality of Peltier devices, each Peltier device being in thermal communication with one or more printing elements 118 so as to adjust the temperature of the or each printing element 118 with which it is in thermal communication.

Figure 5C:
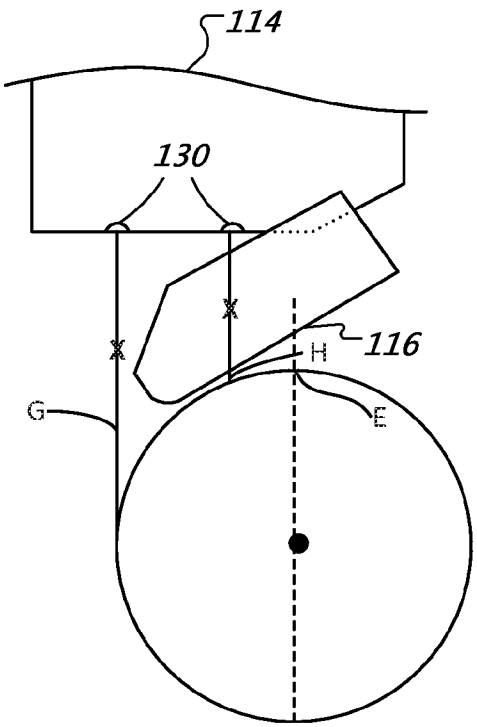
FIG. 5C is a further illustrative view of the top dead centre position locating mechanism, with the printhead of the printing apparatus downstream of the top dead centre position.
Figure 5B:
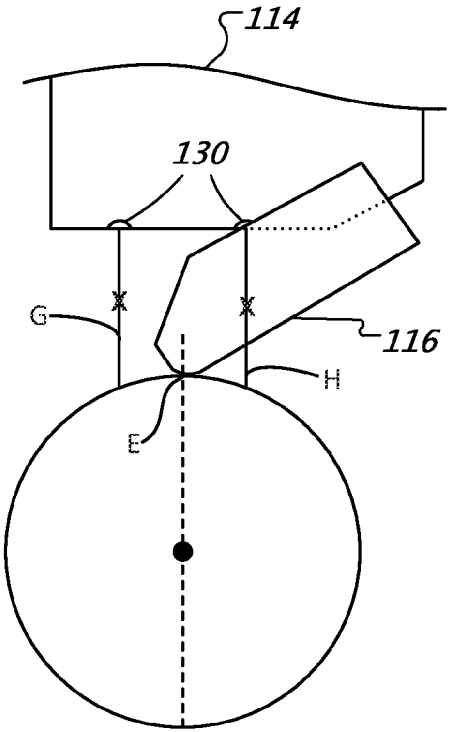
FIG. 5B is a further illustrative view of the top dead centre position locating mechanism, with the printhead of the printing mechanism adjacent the top dead centre position.
Figure 5A:
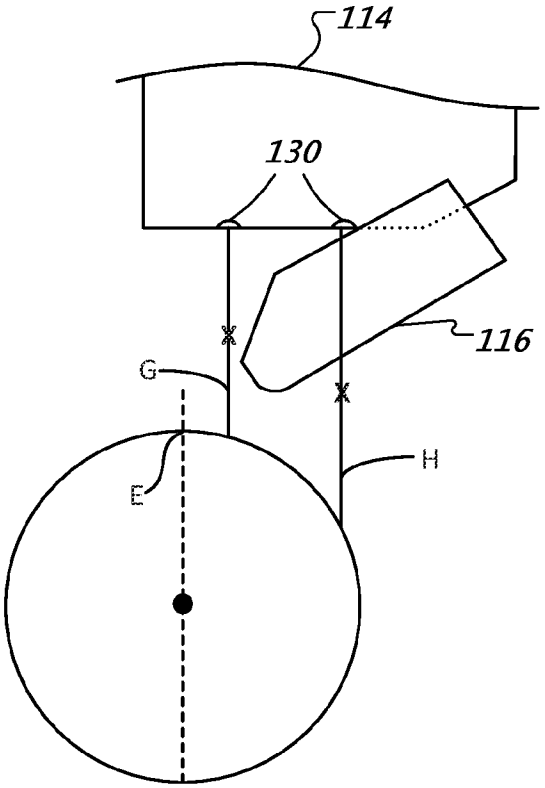
FIG. 5A is an illustrative view of a top dead centre position locating mechanism, with the printhead of the printing apparatus upstream of the print roller.

Referring now to FIGS. 5A, 5B and 5C. In order to determine the position of the top dead centre position E, the TDC-locating device is used, to ascertain the desired position of the printhead 116 relative to the print roller 120 during printing operations. During a calibration step, the printhead 116 is moved in the direction D, such that it traverses the print roller 120. Radiation is emitted from the two emitters 130, as the printhead 116 traverses the print roller 120 and is reflected by the print roller 120 into the detectors 130. When the printhead 116 is positioned directly above the top dead centre position E (see FIG. 5B), the amount of radiation detected by each of the detectors 130 will be substantially equal, since the radiation path lengths G and H between the emitters/detectors 130 and the print roller 120 will be substantially equal.

Alternative devices and methods of locating the top dead centre position E of the print roller are possible. One alternative TDC-locating device includes a single radiation emitter/detector and at least one collimating lens, the radiation detector being capable of detecting only radiation which has been directly reflected towards it. The printhead 116 is moved in the direction D, such that the position of the printhead 116 relative to the print roller 120 is adjusted. As the printhead 116 moves across the print roller 120, the amount of directly reflected radiation received by the detector will peak when the printhead is above the top dead centre position E because the distance between the detector and the print roller 120 will be a minimum at this position, therefore the amount of directly reflected radiation reaching the detector will be at a maximum. The printhead 116 can then be moved to the position at which the detected radiation was a maximum, to ensure that the printhead is positioned accurately adjacent the top dead centre position E.

Figure 6:
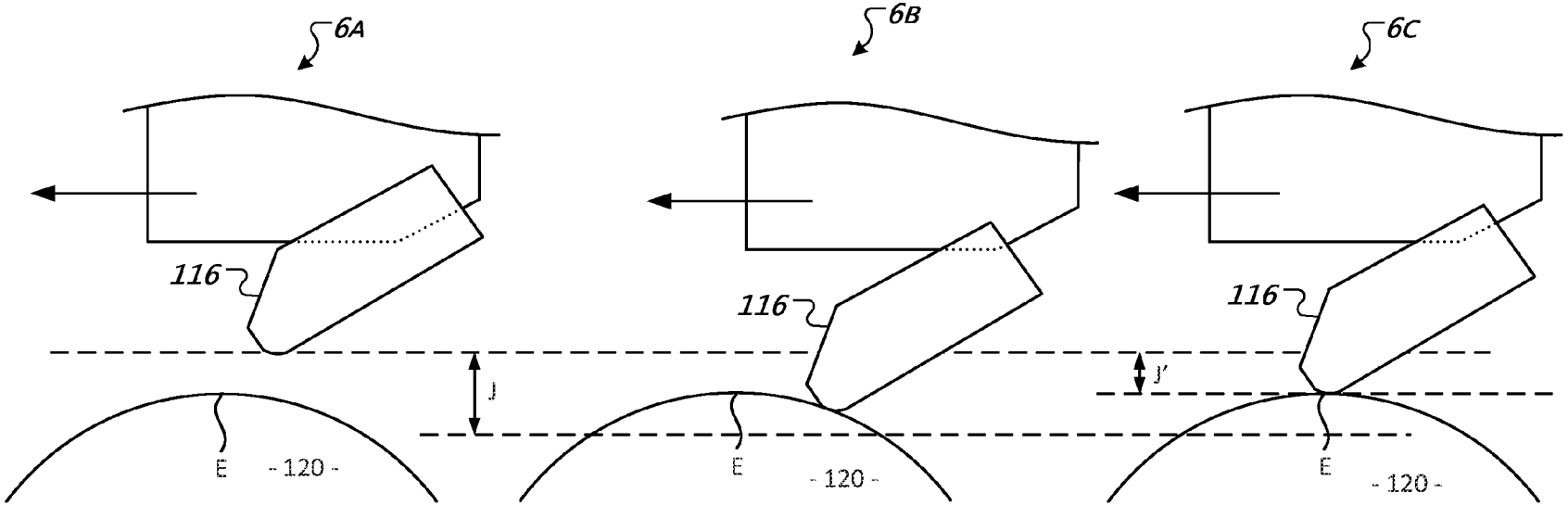
FIG. 6 shows an alternative top dead centre position locating mechanism, in three different positions.

An alternative method of locating the top dead centre position E of the print roller 120, which does not require any radiation emitters/detectors is to repeatedly move the printhead 116 towards and away from the print roller 120, whilst moving the printhead 116 in the direction D relative to the print roller 120. The lateral movement of the printhead 116 and the reciprocating movement 116 of the printhead 116 are preferably carried out simultaneously. This method is illustrated in FIG. 6 at reference characters 6A, 6B and 6C. The time taken for the printhead 116 to move from a first position to a second position in which the printhead 116 contacts the print roller 120 is monitored. The distance J between the first position of the printhead 116 and the print roller 120 is a minimum when the printhead 116 is directly adjacent the top dead centre position E. This distance is shown as J' in FIG. 6.

The time taken for the printhead 116 to contact the print roller 120 will be a minimum when the printhead 116 is directly above the top dead centre position E. Thus, the printhead 116 can be positioned accurately adjacent the top dead centre position E by moving the printhead 116 to the position in which the time taken for the printhead 116 to reach the print roller 120 was a minimum.

A further alternative method of determining the location of the top dead centre position E of the print roller 120 is to monitor the pressure behind an orifice from which an air jet is expelled, directed in the direction "F" toward the print roller, as the printhead 116 traverses the print roller in the direction D. The air pressure behind the orifice will reach a maximum as the distance between the printhead 116 and the print roller 120 reaches a minimum, i.e., as the printhead 116 reaches the top dead centre position E.

Each of the suggested devices and methods of locating the top dead centre position are far more accurate than judging the position by sight.

Whilst the substrate to be printed 122 and the inked ribbon 124 are shown as being transported from right to left during printing operations in the accompanying drawings, it will be appreciated that the printing apparatus 110 could be oppositely "handed", such that the substrate to be printed 122 and the inked ribbon 124 travel from left to right. In such an embodiment, the printhead mount is rotated through 180°. Moreover, the printhead can be of different types. In various implementations, the printhead can include a near edge printhead, a corner edge printhead, a real edge (vertical) printhead, or other thermal transfer printhead, as well as light source printheads, including laser diodes or other thermally energisable printing element.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A printing apparatus comprising:

a print roller for guiding a substrate to be printed, a printhead for transferring ink from a ribbon to the substrate by bringing the ribbon into contact with the substrate at a contact point on the print roller, wherein a printhead angle is subtended between a part of the printhead which transfers ink from the ribbon to the substrate and a radius of the print roller at the contact point, and wherein the printhead angle is adjustable in accordance with a speed of the ribbon relative to the printing apparatus.

2. The printing apparatus according to claim 1, wherein the printhead angle is adjustable, whilst the part of the printhead which transfers ink from the ribbon to the substrate is maintained adjacent a top dead centre position, the top dead centre position of the print roller being a position on the circumference of the print roller defined as the position at which the contact point is the shortest distance of travel of the printhead relative to the print roller, from a refracted, non-printing position to an extended printing position, in a direction which is substantially transverse to a direction of travel of the substrate.

3. The printing apparatus according to claim 1, comprising a controller which is operable to automatically adjust the printhead angle to an optimum angle in accordance with the speed of the ribbon relative to the printing apparatus.

4. The printing apparatus according to claim 1, wherein the printhead is mounted on a printhead support, the printhead being pivotable relative to the printhead support to adjust the printhead angle.

5. The printing apparatus according to claim 1, wherein the printhead includes at least one thermally energisable printing element, the energisation of which is monitored, so as to enable the at least one element to be energised by an appropriate amount to reach a predetermined temperature, taking into account at least one of a current temperature of the at least one element, and the number of times the at least one element has been energised during a predetermined period.

6. The printing apparatus according to claim 5, including a heating element which preheats a portion of the ribbon, prior to the portion of the ribbon reaching the contact point.

7. The printing apparatus according to claim 6, wherein the heating element is an extension of the thermally energisable printing element.

8. The printing apparatus according to claim 7, wherein the heating element is separate from the printhead, and is positioned upstream of the printhead.

9. The printing apparatus according to claim 5, which includes one or more cooling devices for adjusting a temperature of the ink on the ribbon.

10. The printing apparatus according to claim 2, including a mechanism for locating the top dead centre position of the print roller.

11. The printing apparatus according to claim 10, wherein the printhead is moveable in a first, lateral direction relative to the print roller and is moveable in a second direction which is substantially transverse to the first direction, between a first position relative to the print roller and a second position, in which the printhead contacts the print roller.

12. The printing apparatus according to claim 10, wherein the mechanism for locating the top dead centre position of the print roller includes a radiation emitter which is moveable in a lateral direction relative to the print roller, and a radiation detector which detects at least one of radiation emitted by the emitter and radiation reflected by the print roller, an intensity of radiation being detected by the detector being indicative of the detector being positioned adjacent the top dead centre position.

13. The printing apparatus according to claim 12, wherein a maximum intensity of radiation being detected by the detector is indicative of the detector being positioned adjacent the top dead centre position.

14. The printing apparatus according to claim 12, wherein the detector detects only collimated radiation and the mechanism for locating the top dead centre position includes at least one lens for collimating radiation reflected from the print roller.

15. The printing apparatus according to claim 12, wherein the mechanism for locating the top dead centre position includes at least one radiation emitter, and a pair of radiation detectors, the detectors being positioned equidistantly from the top dead centre position, such that the detectors detecting the same intensity of radiation is indicative of radiation path lengths between the top dead centre position and the detectors being equal, hence enabling the top dead centre position to be identified.

16. A printing apparatus including a print roller for guiding a substrate to be printed, a printhead for transferring ink from a ribbon to the substrate by bringing the ribbon into contact with the substrate at a contact point on the print roller and a top dead centre locating mechanism to locate a top dead centre position of the print roller, wherein the top dead centre position of the print roller is a position on the circumference of the print roller defined as the position at which the contact point is the shortest distance of travel of the printhead relative to the print roller, from a retracted, non-printing position to an extended printing position in a direction which is substantially transverse to a direction of travel of the substrate.

17. The printing apparatus according to claim 16, wherein the printhead is moveable in a first, lateral direction relative to the print roller and in a second direction which is substantially transverse to the first direction, between a first position relative to the print roller and a second position, in which the printhead contacts the print roller.

18. The printing apparatus according to claim 16, wherein the top dead centre locating mechanism includes a radiation emitter which is moveable in a lateral direction relative to the print roller, and a radiation detector which detects radiation emitted by the emitter and/or reflected by the print roller, an intensity of radiation being detected by the detector being indicative of the detector being positioned adjacent the top dead centre position.

19. The printing apparatus according to claim 18, wherein a maximum intensity of the of radiation being detected by the detector is indicative of the detector being positioned adjacent the top dead centre position.

20. The printing apparatus according to claim 18, wherein the detector detects only collimated radiation and the top dead centre locating mechanism includes at least one lens to collimate radiation reflected from the print roller.

21. The printing apparatus according to claim 18, wherein the top dead centre locating mechanism includes at least one radiation emitter and a pair of radiation detectors, the detectors being positioned equidistantly from the top dead centre position, such that the detectors detecting the same intensity of radiation is indicative of radiation path lengths between the top dead centre position and the detectors being equal, hence enabling the top dead centre position to be identified.

22. A method of locating a top dead centre position of a print roller of a printing apparatus, the printing apparatus further including a printhead including at least one printing element, the printhead being operable to transfer ink from an inked ribbon to a substrate to be printed by bringing the ribbon into contact with the substrate at a contact point on the print roller, the method including moving at least a part of the printhead in a lateral direction relative to the print roller, such that the printhead traverses the print roller in a first direction, and moving the printhead in a direction which is substantially transverse to the first direction, between a first position and a second position in which a part of the printhead contacts the print roller, the method further including determining the lateral position of the printhead relative to the print roller at which the distance between the first position and the second position is a minimum.

23. The method according to claim 22, wherein the printhead traversing the print roller and the movement of the printhead in the direction which is substantially transverse to the first direction are performed simultaneously.

24. The method according to claim 22, wherein the method includes determining the time taken for the printhead to travel from the first position to the second position.

25. The method according to claim 22, including providing a radiation emitter and a radiation detector which detects radiation emitted by the emitter and/or reflected by the print roller, moving the emitter relative to the print roller in a lateral direction, and monitoring the radiation detected by the detector, to ascertain the position of the emitter relative to the print roller when the intensity of the radiation is a maximum, and thus determining the position of the top dead centre position.

26. The method according to claim 22, including moving the printhead in a first direction laterally relative to the print roller and repeatedly moving the printhead in a second direction which is substantially transverse to the first direction, between a first position relative to the print roller and a second position in which the printhead contacts the print roller, and monitoring one of the time taken for the printhead to move between the first position and the second position, and the distance between the first position and the second position, so as to ascertain the shortest distance travelled by the printhead between the first position and the second position, and thus to ascertain the lateral position of the top dead centre position.

27. A method of adjusting the effective length of a printing element of a printing apparatus, the printing apparatus being of the kind including a print roller for guiding a substrate to be printed, a printhead including at least one printing element, the printhead being operable to transfer ink from an inked ribbon to the substrate by bringing the ribbon into contact with the substrate at a contact point on the print roller, wherein a printhead angle is subtended between a part of the printhead which transfers ink from the ribbon to the substrate and a radius of the print roller at the contact point wherein the method includes adjusting the printhead angle in accordance with the speed of the ribbon relative to the printing apparatus.

28. The method according to claim 27, wherein the printhead angle is adjusted whilst part of the printhead which transfers ink from the ribbon to the substrate is maintained adjacent a top dead centre position of the print roller, during printing, the top dead centre position being the contact point on the circumference of the print roller at which a distance moved by the printhead between a first position and the contact point in a direction substantially transverse to a direction of travel of the ribbon relative to the print roller, is a minimum.

* * * * *

UNITED STATES PATENT AND TRADEMARK OFFICE

CERTIFICATE OF CORRECTION

PATENT NO. : 8,711,193 B2
APPLICATION NO. : 13/399665
DATED : April 29, 2014
INVENTOR(S) : Frances H. Benton et al.

It is certified that error appears in the above-identified patent and that said Letters Patent is hereby corrected as shown below:

In the Claims

Column 13, line 36, claim 2, delete “refracted,” and insert --retracted,-- therefor.

Signed and Sealed this
Ninth Day of September, 2014

Michelle K. Lee

Michelle K. Lee
*Deputy Director of the United States Patent and Trademark Office*